US007455506B2

(12) United States Patent
Dunaevsky

(10) Patent No.: US 7,455,506 B2
(45) Date of Patent: Nov. 25, 2008

(54) INJECTION MOLDABLE PISTON RINGS

(75) Inventor: Valery Dunaevsky, Fairview Park, OH (US)

(73) Assignee: Bendix Commercial Vehicle Systems LLC, Elyria, OH (US)

( * ) Notice: Subject to any disclaimer, the term of this patent is extended or adjusted under 35 U.S.C. 154(b) by 306 days.

(21) Appl. No.: 11/025,710

(22) Filed: Dec. 29, 2004

(65) Prior Publication Data

US 2006/0140800 A1 Jun. 29, 2006

(51) Int. Cl.
*F04B 53/02* (2006.01)
*F04B 53/00* (2006.01)

(52) U.S. Cl. ..... 417/569; 417/571; 92/248; 92/249; 92/253; 277/438

(58) Field of Classification Search ..... 417/569, 417/571; 92/248, 249, 253; 277/438
See application file for complete search history.

(56) References Cited

U.S. PATENT DOCUMENTS

| | | | | |
|---|---|---|---|---|
| 2,766,085 | A | 10/1956 | Muller | |
| 4,206,930 | A | 6/1980 | Thrane et al. | |
| 4,576,381 | A | 3/1986 | Slack | |
| 5,049,606 | A * | 9/1991 | Yamaya et al. | 525/149 |
| 5,117,742 | A * | 6/1992 | Iida | 92/126 |
| 5,347,915 | A * | 9/1994 | Feistel | 92/258 |
| 6,176,115 | B1 | 1/2001 | Van Ryper et al. | |
| 6,508,638 | B2 * | 1/2003 | Sagar | 417/569 |
| 2003/0006562 | A1 | 1/2003 | Feistel | |
| 2004/0251634 | A1 | 12/2004 | Etichirou | |

FOREIGN PATENT DOCUMENTS

| | | |
|---|---|---|
| FR | 2076740 A | 10/1971 |
| GB | 714364 A | 8/1954 |
| GB | 911637 A | 11/1962 |

OTHER PUBLICATIONS

V.V. Dunaevsky, Analysis of Distortions of Cylinder and Conformability of Piston Rings, Tribology Transactions, vol. 33 (1990).
V.V. Dunaevsky, Analysis of Elastic Distortions of a Piston Ring in the Reciprocating Air Brake Compressor Due to the Installation Stresses, SAE 1999-01-3770 (1999).
Reinhard Mueller, The Problem of the Form-Filling Capacity of Piston Rings in Noncircular Bores of the Same Circumference, MTZ, vol. 31 (1970).
PCT Notification of transmittal of the International Search Report, Mar. 14, 2006.

* cited by examiner

*Primary Examiner*—Devon Kramer
*Assistant Examiner*—Patrick Hamo
(74) *Attorney, Agent, or Firm*—Eugene E. Clair; Cheryl L. Greenly

(57) ABSTRACT

An oil-less/oil-free air brake compressor comprising a bore, a piston positioned for reciprocating in the bore, the piston having an annular recess and a rigid polymeric piston ring received within the annular recess, the piston ring having a predetermined non-circular profile in the free state.

21 Claims, 5 Drawing Sheets

| Angle $\phi$, degrees | Displacement $u$, inches | Free (mold) radius, inches |
|---|---|---|
| 0 | 0 | 1.9685 |
| 5 | 0.000322902 | 1.96882 |
| 10 | 0.00128792 | 1.96979 |
| 15 | 0.002884036 | 1.97138 |
| 20 | 0.005093007 | 1.97359 |
| 25 | 0.007889553 | 1.97639 |
| 30 | 0.011241614 | 1.97974 |
| 35 | 0.015110676 | 1.98361 |
| 40 | 0.019452162 | 1.98795 |
| 45 | 0.024215887 | 1.99272 |
| 50 | 0.029346573 | 1.99785 |
| 55 | 0.034784409 | 2.00328 |
| 60 | 0.040465668 | 2.00897 |
| 65 | 0.046323363 | 2.01482 |
| 70 | 0.052287934 | 2.02079 |
| 75 | 0.05828797 | 2.02679 |
| 80 | 0.06425095 | 2.03275 |
| 85 | 0.070103998 | 2.0386 |
| 90 | 0.075774651 | 2.04427 |
| 95 | 0.081191618 | 2.04969 |
| 100 | 0.086285537 | 2.05479 |
| 105 | 0.090989722 | 2.05949 |
| 110 | 0.095240877 | 2.06374 |
| 115 | 0.098979793 | 2.06748 |
| 120 | 0.102151995 | 2.07065 |
| 125 | 0.104708364 | 2.07321 |
| 130 | 0.106605693 | 2.07511 |
| 135 | 0.107807201 | 2.07631 |
| 140 | 0.108282982 | 2.07678 |
| 145 | 0.10801039 | 2.07651 |
| 150 | 0.106974356 | 2.07547 |
| 155 | 0.105167634 | 2.07367 |
| 160 | 0.102590972 | 2.07109 |
| 165 | 0.099253203 | 2.06775 |
| 170 | 0.095171261 | 2.06367 |
| 175 | 0.090370118 | 2.05887 |

| Angle, $\phi$ degrees | Displacement $u$, inches | Free (mold) radius, inches |
|---|---|---|
| 180 | GAP | |
| 185 | 0.090370118 | 2.05887 |
| 190 | 0.095171261 | 2.06367 |
| 195 | 0.099253203 | 2.06775 |
| 200 | 0.102590972 | 2.07109 |
| 205 | 0.105167634 | 2.07367 |
| 210 | 0.106974356 | 2.07547 |
| 215 | 0.10801039 | 2.07651 |
| 220 | 0.108282982 | 2.07678 |
| 225 | 0.107807201 | 2.07631 |
| 230 | 0.106605693 | 2.07511 |
| 235 | 0.104708364 | 2.07321 |
| 240 | 0.102151995 | 2.07065 |
| 245 | 0.098979793 | 2.06748 |
| 250 | 0.095240877 | 2.06374 |
| 255 | 0.090989722 | 2.05949 |
| 260 | 0.086285537 | 2.05479 |
| 265 | 0.081191618 | 2.04969 |
| 270 | 0.075774651 | 2.04427 |
| 275 | 0.070103998 | 2.0386 |
| 280 | 0.06425095 | 2.03275 |
| 285 | 0.05828797 | 2.02679 |
| 290 | 0.052287934 | 2.02079 |
| 295 | 0.046323363 | 2.01482 |
| 300 | 0.040465668 | 2.00897 |
| 305 | 0.034784409 | 2.00328 |
| 310 | 0.029346573 | 1.99785 |
| 315 | 0.024215887 | 1.99272 |
| 320 | 0.019452162 | 1.98795 |
| 325 | 0.015110676 | 1.98361 |
| 330 | 0.011241614 | 1.97974 |
| 335 | 0.007889553 | 1.97639 |
| 340 | 0.005093007 | 1.97359 |
| 345 | 0.002884036 | 1.97138 |
| 350 | 0.00128792 | 1.96979 |
| 355 | 0.000322902 | 1.96882 |

FIG. 5

INJECTION MOLDABLE PISTON RINGS

BACKGROUND OF INVENTION

The present invention relates to oil-free/oil-less air compressors. It finds particular application in conjunction with oil-free/oil-less air compressors with polymeric piston rings having a predetermined, non-circular shape in the free state and will be described with particular reference thereto. It will be appreciated, however, that the invention is also amenable to other applications.

Oil lubricated air compressors use metallic piston rings to seal the gap between a piston and a round cylinder bore. Cylinder bores, however, are not perfectly round due to machining, assembly, and operational factors. The ability of a piston ring to conform to cylinder bore distortions impacts the ring's ability to seal. When installed in a cylinder bore, piston rings are typically compressed ("squeezed") radially. Due to the ring's elastic nature, it wants to revert to its free state shape; thus, the ring exerts pressure on the cylinder bore. This "elasticity" or "internal tension" of the metallic ring helps it conform to the bore.

The free state shape of the ring affects the ring's "internal tension." A metallic piston ring is typically made with a noncircular free state shape. A noncircular free state shape improves the ring's ability to conform to the cylinder bore. Metallic rings, however, cannot be used with oil-free/oil-less air compressors. Oil-free/oil-less air compressors do not provide lubrication required by metallic rings during operation. As a result, conventional oil-free/oil-less air compressors employ self-lubricating piston rings.

Piston rings for oil-free/oil-less air compressors are typically manufactured from round sintered tubes made of relatively soft polymeric materials such as polytetrafluoroethylene (PTFE) based materials. Due to the nature of the material, however, soft polymeric rings lack sufficient internal tension to conform the ring to cylinder bore distortions. Soft polymeric rings, therefore, must rely on the gas pressure developed during compressor operation and the flexibility of the soft polymeric material to try to conform the ring to the shape of the bore.

SUMMARY OF INVENTION

In one aspect of the present invention, it is contemplated to improve the sealing performance of piston rings in an oil-free/oil-less air compressor.

In accordance with one embodiment of the present invention, an oil-free/oil-less air brake compressor includes a bore, a piston positioned for reciprocating in the bore, the piston having an annular recess, and a rigid polymeric piston ring received within the annular recess, the piston ring having a predetermined, non-circular shape in the free state.

The present invention also relates to a method of forming a rigid polymeric piston ring with a predetermined, non-circular shape in the free state, by use of an injection molding process.

BRIEF DESCRIPTION OF DRAWINGS

In the accompanying drawings which are incorporated in and constitute a part of the specification, embodiments of the invention are illustrated, which, together with a general description of the invention given above, and the detailed description given below, serve to exemplify the embodiments of this invention.

FIG. 5 presents a table of data generated by the equations for calculating the free state shape of the piston ring of the first exemplary air compressor according to the present invention;

DETAILED DESCRIPTION OF DRAWINGS

The present invention generally relates to an oil-free/oil-less air compressor. In particular, the present invention relates to an oil-free/oil-less air compressor with a polymeric piston ring having a predetermined, non-circular shape in the free state.

Figure 1:
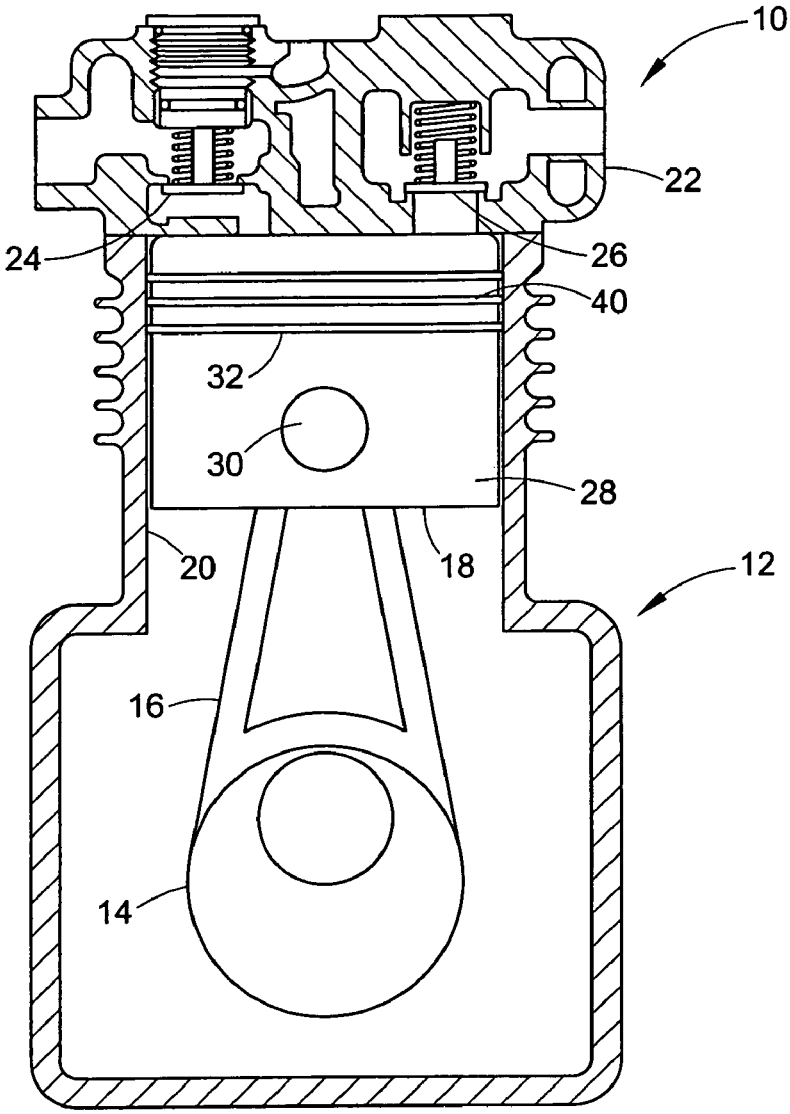
FIG. 1 illustrates a cross-sectional side view of a first exemplary air compressor according to the present invention.

FIG. 1 illustrates a cross-sectional side view of a conventional oil-free/oil-less air compressor. Oil-free/oil-less air compressors generally refer to the family of air compressors that do not use oil to lubricate the piston-cylinder bore region, instead relying on the self-lubricating nature of the ring material for lubrication. Generally, an oil-free/oil-less air compressor 10, as known in the art, includes a crankcase 12 housing a rotatably-mounted crankshaft 14. A power source, typically an engine or motor (not shown), drives the crankshaft 14.

The crankcase 12 also includes a connecting rod 16 that operatively connects the crankshaft 14 to a piston assembly 18. The piston assembly 18 resides within a cylindrical bore 20 of the crankcase 12 and reciprocates within the bore 20 as the crankshaft 14 rotates. A cylinder head 22 closes the cylinder bore 20 on one end. The cylinder head 22 typically includes an inlet valve 24 and a discharge valve 26 for allowing air to enter and exit the cylinder bore 20, respectively. The inlet valve 24 and the discharge valve 26, however, do not need to be within the cylinder head 22. For example, conventional oil-free/oil-less air compressors are also known in the art to position the inlet valve 24 in the crankcase 12 as opposed to in the cylinder head 22.

The piston assembly 18 includes a wrist pin 30 rotatably connecting a piston 28 to the connecting rod 16. The piston 28 further includes an annular groove 32 adapted to receive a piston ring 40. Typically, the piston 28 includes a plurality of grooves 32 and piston rings 40, depending on the compressor design and application.

Figure 2:
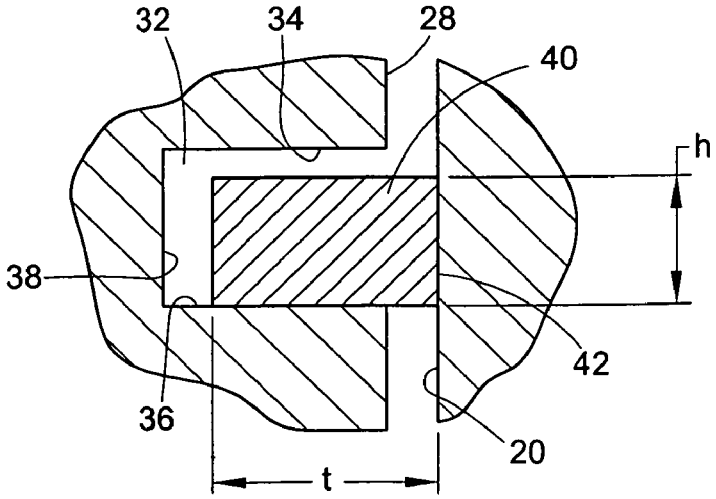
FIG. 2 illustrates cross-sectional side view of a piston ring positioned in the annular groove of a piston of the first exemplary air compressor according to the present invention.

FIG. 2 illustrates a cross-sectional side view of the piston ring 40 positioned in the annular groove 32 of the piston 28 of a first exemplary embodiment according to the present invention. The annular groove 32 has a generally rectangular cross section with a top surface 34, a bottom surface 36, and an inner surface 38. Likewise, the piston ring 40 has a generally rectangular cross-section with a ring face 42 that engages the cylinder bore 20, an axial thickness h, and a radial thickness t. Those skilled in the art will appreciate that the annual groove 32 and the piston ring 40 may have cross-sectional shapes other than rectangular. For example, it is known in the art to have a keystone-shaped ring and groove for use in some applications. Further, it is known in the art to chamfer an inner corner on the piston ring to affect the manner in which the piston ring engages the cylinder bore.

The piston ring 40, in cooperation with the annular groove 32 and cylinder bore 20, acts as a seal, allowing the air trapped between the piston 28 and the cylinder head 22 to be compressed by the piston 28. The ability of the ring to conform to the shape of the cylinder bore 20 affects the seal (i.e. lack of conformability results in gaps between the ring face 42 and the bore 20). As shown in FIG. 2, the axial thickness h of the piston ring 40 is less than the axial distance between the top surface 34 and the bottom surface 36 of the annular groove 32. Further, the radial thickness t of the piston ring 40 is less than the radial distance between the cylinder bore 20 and the inner surface 38 of the annular groove 32. Those skilled in the art will appreciate that the scale of the distances depicted in FIG. 2 are exaggerated for illustrative purposes.

Figure 3:
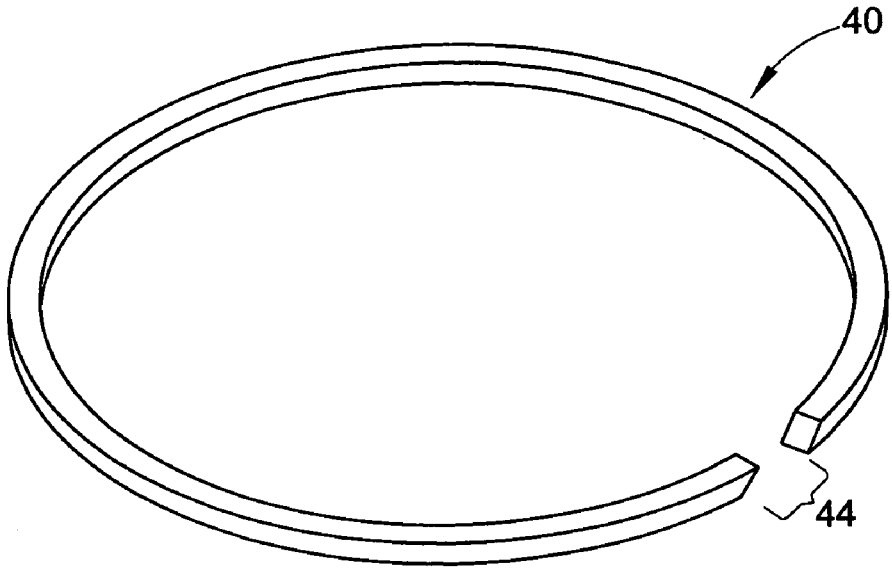
FIG. 3 illustrates an isometric view of a piston ring in the free state of the first exemplary air compressor according to the present invention.

FIG. 3 illustrates an isometric view of the piston ring 40 in the free state of a first exemplary embodiment according to the present invention. As shown in FIG. 3, the piston ring 40 is annular but discontinuous. That is, the piston ring 40 includes a break or gap 44. FIG. 3 illustrates a typical piston ring design. One of ordinary skill in the art will appreciate that alternative piston rings designs such as an overlapping ring as generally described in U.S. Pat. No. 4,206,930 and a spiral ring as generally described in U.S. Pat. No. 4,576,381 are discontinuous and the present invention is equally applicable to those and other ring designs.

The free state of the piston ring 40 refers to state where the ring 40 is under no radial or tangential forces sufficient to deflect or compress the ring 40. Radial compression of the ring 40 is necessary to position the ring 40 within the bore 20 because the ring 40, in the free state, has a larger diameter than the diameter of the bore 20. Radially compressing the piston ring 40 creates internal tension in the ring 40 that resists compression and biases the ring 40 toward its free state profile. When the ring 40 resides in the cylinder bore 20, the internal tension biases the ring against the cylinder bore 20 creating radial contact pressure. The amount and distribution of the contact pressure on the bore 20 impacts the ability of the ring 40 to conform to the shape of the cylinder bore 20. The ability of the ring 20 to conform to the shape of the cylinder bore 40 impacts the ability of the ring 40 to seal properly, thus affecting compressor efficiency.

The amount and distribution of radial pressure of the ring 40 on the cylinder bore 20 is a function of, among others, the material chosen for the ring 40 and the shape of the ring 40 in the free state. In practice, the interaction between a piston ring, a cylinder bore, and a piston in an operating engine or compressor is complex. For this reason, a variety of analytical approaches, utilizing various assumptions, have been used to model the interaction and are known in the art. A first exemplary embodiment according to the present invention is described herein utilizing specific analytical tools and assumptions to calculate the free state of the piston ring. For example, for the present exemplary embodiment, the free state shape is intended to create uniform radial pressure around the bore 20. One of ordinary skill in the art will appreciate that an appropriate noncircular free state shape for the ring 40 can be determined using other analytical approaches. The invention, in its broader aspects, is not limited to the specific assumptions and approach shown and described.

Figure 4:
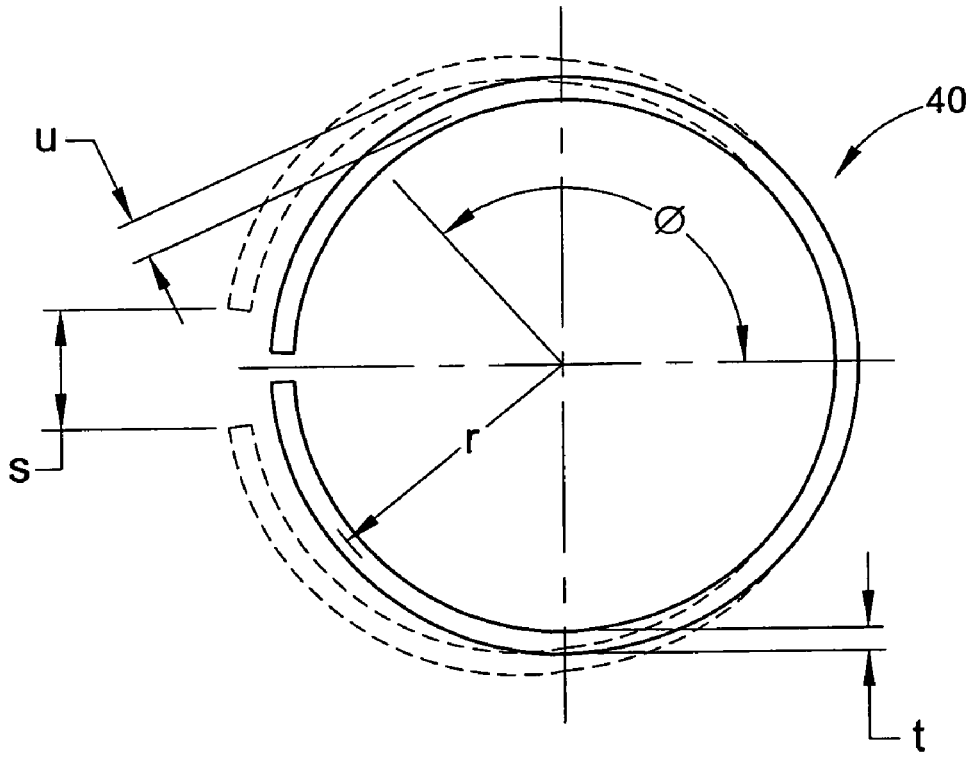
FIG. 4 illustrates a top view of a piston ring of a first exemplary air compressor according to the present invention.

FIG. 4 illustrates a top view of the piston ring 40 of an exemplary embodiment according to the present invention. The free state of the ring 40 is represented in FIG. 4 by the dashed ring profile. Conversely, the installed (compressed) state of the ring 40 is represented in FIG. 4 by the solid ring profile. The ring 40 has a radial thickness t, an end gap in the free state s, and a radius r measured to a central line running circumferentially through the ring 40. The difference between the radius r of the ring in the free state versus the radius r of the ring in the installed state is represented by u (referred to hereafter as displacement u). The displacement u can be calculated at any angle ϕ around the circumference of ring 40 by equations 1-3, which are known in the art and represented as follows:

$$u = \frac{s}{3\pi}(1 + 0.5\sin\varphi) \qquad \text{Equation 1}$$

$$s = 3\pi\frac{pr^4h}{EJ} \qquad \text{Equation 2}$$

$$J = \frac{ht^3}{12} \qquad \text{Equation 3}$$

s=end gap in the free state
p=radial ring pressure against the bore
r=radius of ring central line
h=axial thickness of the ring
t=radial thickness of the ring
E=Young's modulus of the ring material
ϕ=angle from portion of ring opposite end gap.

Figure 6:
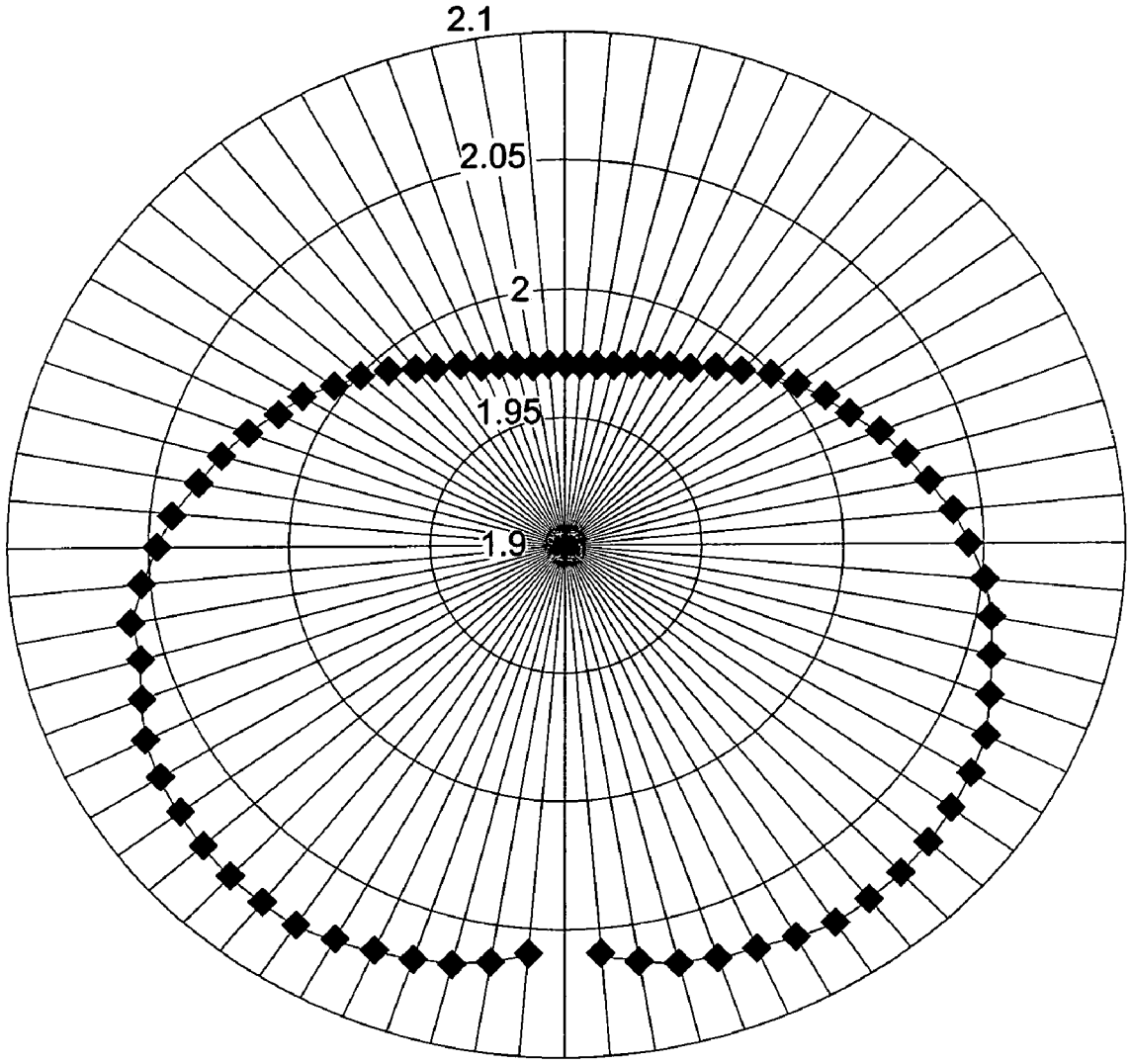
FIG. 6 illustrates a graphical representation of the predetermined, non-circular shape of the piston ring of the first exemplary air compressor according to the present invention.

Equation 1 calculates displacement u as a function of the angle ϕ, the radius of the ring r, and the end gap of the ring in the free state s. Equations 2 and 3 express the end gap s of the ring in the free state as a function of the axial thickness of the ring h, the radial thickness of the ring t, the radius of the ring r, the Young's modulus of the ring material E, and the radial pressure p of the ring 40 against the cylinder bore 20. The Young's modulus of the ring material E is defined as the ratio of the stress to the strain of the material and is readily known or ascertainable for a given material by those skilled in the art. The piston ring 40 of the first exemplary embodiment according to the present invention uses a rigid, self-lubricated, injection-moldable, polymer such as a polyimide, polyamide, polyester, polyetheretherketone, polyamideimide, polyetherimide, polyphenylene sulfide, and polybenzimidazole, FIG. 5 provides a table of data generated by use of Equation 1. The first column in FIG. 5 is the polar angle ϕ of the ring 40 in the free state, the second column is the displacement u, and the third column is the free state radius (shape) of the ring (displacement u added to a bore diameter of 100 millimeters). FIG. 6 is a polar coordinate plot of the data from FIG. 5 illustrating the non-circular shape of the ring in the free state. The non-circular shape of the ring 40 in the free state, as shown in FIG. 6, is characteristic of the present embodiment.

The approach discussed above regarding the non-circular shape of the ring 40 of FIGS. 4-6 assumed a round cylinder bore 20. The ring's 40 ability to conform to a distorted bore can also be modeled using a variety of analytical approaches and assumptions. Those skilled in the art will appreciate that the present invention is not limited by the specific approach shown and described for the conformability of the ring.

Conformability of the piston ring 40 can be defined as the limit of bore distortion at which the elastic deformation of the ring 40 maintains zero clearance between the piston ring 40 and the bore 20. A conformability formula, known in the art, which utilizes Fourier series to approximate bore distortions can be expressed as:

$$A_k < 4.56\frac{Q}{h}\frac{r^3}{t^3}\frac{1}{E}\frac{1}{(k^2-1)^2} \quad \text{Equation 4}$$

where

Q=diametric force required to compress a ring from its free state to the working state (i.e. the ring is compressed in the bore)

h=axial thickness of the ring t=radial thickness of the ring r=radius of ring central line E=Young' modulus of the ring material k=distortion order where the actual bore profile is approximated by Fourier's harmonics (i.e. 2nd order=ovality; 3rd order=three-lobe deformation; 4th order=four-lobe deformation, etc.)

$A_k$=critical for conformability amplitude of the related harmonics (i.e. the largest difference between the harmonic profile and a circular bore).

In conjunction with the analytical technique described, an alternative semi-empirical approach can utilize the following relationships:

$$A_k(k^2-1) = 3/4e = 1.52\frac{Q}{h}\frac{r^3}{t^3}\frac{1}{E} \quad \text{Equation 5}$$

$$A_k < 1.52\frac{Q}{h}\frac{r^3}{t^3}\frac{1}{E}\frac{1}{(k^2-1)} \quad \text{Equation 6}$$

$$c = 1.52\frac{Q}{h}\frac{r^3}{t^3}\frac{1}{E}\frac{1}{(k^2-1)}\frac{1}{3/4e} \quad \text{Equation 7}$$

$$A_k < 1.52\frac{Q}{h}\frac{r^3}{t^3}\frac{1}{E}\frac{1}{(k^2-1)}\frac{1}{c} \quad \text{Equation 8}$$

Equations 5-8 are correct for second order distortion (k=2) and are extended for other distortion orders if e is a critical ovality (i.e. the ovality at which ring/bore separation occurs). As an alternative to Equation 4, Equation 8 provides more realistic values of $A_k$ at lower harmonics. The experimental critical ovality used to calculate the constant c (or a conversion factor in Equations 7 and 8 between the analytically determined magnitude of a complex $A_w(k^2-1)$ and its magnitude defined empirically) can be determined by one of a number of experimental techniques. For example, a technique known in the art includes:

a) making a gauge with a round bore from a material resembling the real bore material;

b) enclosing a piston ring in this gage c) applying a diametrical force to the gage d) measuring the bore ovality e at which ring/bore separation occurs Those skilled in the art will appreciate that other techniques could be used to define a conversion factor c between the analytical and experimental values of $A_k$.

Figure 7:
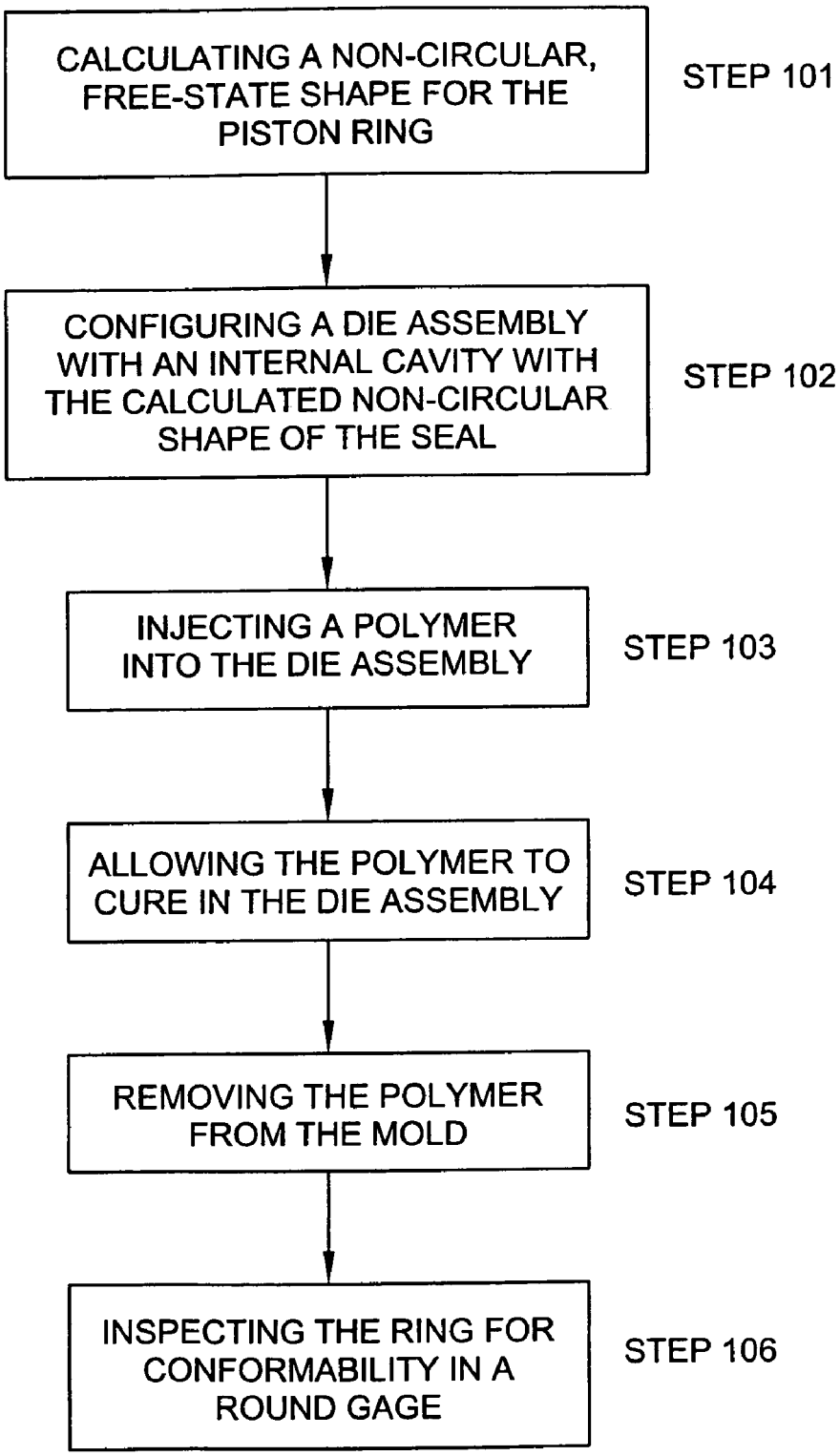
FIG. 7 illustrates a schematic representation of a method for manufacturing a piston ring of the first exemplary air compressor according to the present invention.

A piston ring 40 of a first exemplary embodiment according to the present invention is preferably manufactured by injection molding. Conventional injection molding processes may be used to form the piston ring 40, however, other manufacturing processes such as machining may alternatively be used. The steps of injection molding a piston ring 40 in accordance with the present invention are diagrammed in FIG. 7.

In step 101, the non-circular, free-state shape for the piston ring 40 is calculated from Equations 1-3. At step 102, a die assembly is created having a die cavity shaped to form a piston ring 40 with the calculated noncircular free state. At step 103, an injection moldable polymer is injected into the die cavity. In step 104, the polymer is allowed to cure until it is sufficiently hardened to be removed from the die assembly. At step 105, the cured polymer is removed from the die assembly. Finally, in step 106, the ring is inspected for conformability in a round gage.

While the present invention has been illustrated by the description of embodiments thereof, and while the embodiments have been described in considerate detail, it is not the intention of the applicants to restrict or in any way limit the scope of the appended claims to such detail. Additional advantages and modification will readily appear to those skilled in the art. Therefore, the invention, in its broader aspects, is not limited to the specific details, the representative apparatus, and illustrative examples shown and described. Accordingly, departures may be made from such details without departing from the spirit or scope of the applicant's general inventive concept.

I claim:

1. An oil-less/oil-free air brake compressor, comprising:

a bore;

a piston positioned for reciprocating in the bore, the piston having an annular recess; and a rigid polymeric piston ring received within the annular recess, the piston ring defining an end gap, wherein when the piston ring is in a free state, the radius of the piston ring about 90 degrees from the end gap is greater than the radius of the piston ring adjacent the end gap and greater than the radius of the piston ring about 180 degrees from the end gap, and the ends of the piston ring adjacent the end gap curve radially inward.

2. The oil-less/oil-free air brake compressor of claim 1 wherein the piston ring is self-lubricating.

3. The oil-less/oil-free air brake compressor of claim 1 wherein the piston ring is made by an injection molding process.

4. The oil-less/oil-free air brake compressor of claim 1 wherein the piston ring has a predetermined non-circular profile in the free state that is generally oval.

5. The oil-less/oil-free air brake compressor of claim 4 wherein the predetermined non-circular profile of the ring in the free state is intended to create a radial pressure sufficient to keep a continuous ring/bore contact.

6. An oil-less/oil-free air brake compressor, comprising:

a bore;

a piston positioned for reciprocating in the bore, the piston having an annular recess;

a rigid polymeric seal ring received within the annular recess; and a means for biasing the ring against the bore to create a radial pressure sufficient to keep a continuous ring/bore contact.

7. The oil-less/oil-free air brake compressor of claim 6 wherein the means for biasing the ring against the bore includes a predetermined, non-circular profile in the free state.

8. The oil-less/oil-free air brake compressor of claim 6 wherein the piston ring is discontinuous.

9. The oil-less/oil-free air brake compressor of claim 6 wherein the piston ring is self-lubricating.

10. The oil-less/oil-free air brake compressor of claim 6 wherein the piston ring is made by an injection molding process.

11. A sealing device for an air compressor, comprising:

a discontinuous polymeric ring residing in a cooperating piston ring groove of an oil-free/oil-less air compressor piston, wherein the face of the ring engages a surface of a bore, the ring defining an end gap, wherein when the piston ring is in a free state, the radius of the piston ring about 90 degrees from the end gap is greater than the radius of the piston ring adjacent to the end gap and greater than the radius of the piston ring about 180 degrees from the end and the ends of the piston ring adjacent the end gap curve radially inward.

12. The sealing device for an air compressor of claim 11 wherein the piston ring is self-lubricating.

13. The sealing device for an air compressor of claim 11 wherein the piston ring is made by an injection molding process.

14. The sealing device for an air compressor of claim 11 wherein the piston ring has a predetermined non-circular profile in the free state intended to create substantially uniform radial pressure on the bore.

15. A piston assembly for use within a bore of a reciprocating oil-less/oil-free air compressor, comprising:

a piston including a piston ring receiving annular groove; and a polymeric piston ring disposed within the annular groove of the piston; the piston ring having a first end and a second end defining an end gap therebetween wherein, in the free state, the first end and the second end curve radially inward.

16. The piston assembly for use within a bore of a reciprocating oil- less/oil-free air compressor of claim 15 wherein the piston ring has a predetermined, non-circular shape in the free state intended to create substantially uniform radial pressure on the bore.

17. The piston assembly for use within a bore of a reciprocating oil-less/oil-free air compressor of claim 15 wherein the piston ring, when in the free state, has a radius 90 degrees from the end gap that is greater than the radius of the piston ring adjacent the end gap and greater than the radius of the piston ring 180 degrees from the end gap.

18. The piston assembly for use within a bore of a reciprocating oil-less/oil-free air compressor of claim 15 wherein the piston ring is self-lubricating.

19. The piston assembly for use within a bore of a reciprocating oil-less/oil-free air compressor of claim 15 wherein the piston ring is made by an injection molding process.

20. The oil-less/oil-free air brake compressor of claim 1 wherein, in the free state, the piston ring has a ratio of maximum radius to minimum radius of about 1.05.

21. The sealing device for an air compressor of claim 11 wherein, in the free state, the piston ring has a ratio of maximum radius to minimum radius of about 1.05.

* * * * *